US007743693B1

(12) United States Patent
Brittingham

(10) Patent No.: US 7,743,693 B1
(45) Date of Patent: Jun. 29, 2010

(54) REDUNDANT LATCH SUPPRESSOR MOUNT

(75) Inventor: Kevin Tyson Brittingham, Norcross, GA (US)

(73) Assignee: Advanced Armament Corp., LLC, Madison, NC (US)

( * ) Notice: Subject to any disclaimer, the term of this patent is extended or adjusted under 35 U.S.C. 154(b) by 441 days.

(21) Appl. No.: 11/894,205

(22) Filed: Aug. 20, 2007

Related U.S. Application Data

(60) Provisional application No. 60/904,340, filed on Feb. 28, 2007, provisional application No. 60/927,001, filed on May 1, 2007, provisional application No. 60/931,670, filed on May 24, 2007.

(51) Int. Cl.
*F41A 21/00* (2006.01)

(52) U.S. Cl. ..... 89/14.4; 89/14.2

(58) Field of Classification Search ..... 89/14.1–14.6
See application file for complete search history.

(56) References Cited

U.S. PATENT DOCUMENTS 3,698,747 A * 10/1972 Wing et al. ..... 285/305
5,773,746 A * 6/1998 Vaden ..... 89/14.4
6,385,891 B1 * 5/2002 Rabatin ..... 42/79
6,905,297 B2 * 6/2005 DiStasio et al. ..... 411/329
6,948,415 B2 9/2005 Matthews
7,594,464 B2 * 9/2009 Dueck ..... 89/14.4
2006/0060076 A1 * 3/2006 Dueck et al. ..... 89/14.4
2008/0098880 A1 * 5/2008 Brugger ..... 89/14.4
2008/0156183 A1 * 7/2008 Brittingham ..... 89/14.4

* cited by examiner

*Primary Examiner*—J. Woodrow Eldred
*Assistant Examiner*—Gabriel J Klein
(74) *Attorney, Agent, or Firm*—Wood, Herron & Evans, L.L.P.; Glenn D. Bellamy

(57) ABSTRACT

A mount designed to be integrated into a noise suppressor. The proposed apparatus encompasses an acme thread and two springs which serve as secondary latches. Offsetting the secondary spring latches in such a manner as to ensure one always fully seats into the indexing points of a flash hider mount limits the rotational movement of an installed noise suppressor which incorporates my proposed mount. Further, this method is more cost efficient than timing each flash hider with each noise suppressor mount.

7 Claims, 1 Drawing Sheet

SECTION A-A

SECTION C-C

VIEW B-B

REDUNDANT LATCH SUPPRESSOR MOUNT

This application claims the benefit of U.S. Provisional Patent Application Nos. 60/904,340, filed Feb. 28, 2007; 60/927,001, filed May 1, 2007; and 60/931,670, filed May 24, 2007.

BACKGROUND OF THE INVENTION

1. Field of Invention

This invention generally relates to firearms, specifically to noise suppressors and devices which are used to rotationally restrain the noise suppressor on the muzzle of a firearm and prevent it from backing off due to the incidental vibrations resulting from the discharge of the host firearm.

2. Prior Art

Previous systems exist for attaching noise suppressors to a firearm, and specifically for removing or attaching a noise suppressor to a flash suppressor affixed to the muzzle of a firearm. Systems such as the one presented in Advanced Armaments Corp, Inc's M4-2000 fall short in several areas such as secondary latch engagement between the teeth present about the rear of the preferred embodiment flash hider once the silencer is completely threaded on. There is a need for a secure attachment system for mounting noise suppressors to a firearm particularly a flash suppressor which will withstand the vibrations incidental to firing an automatic rifle or other small arm, provide for an secondary spring latch which will reliably engage the teeth located about the flash hider once the host noise suppressor is threadedly secure without requiring the noise suppressor to be backed off to ensure proper engagement of the secondary spring latch.

Designs such as the one present in Surefire U.S. Pat. No. 6,948,415 fail to provide several features which are novel to my design. The mounting system referenced requires two hands to mount. When a solider or police officer is manipulating a firearm with one hand it is not possible to fully attach a noise suppressor which utilizes the referenced mount. The mounting ring may also become stuck making it difficult to remove the attach noise suppressor should it become damaged.

Designs where the mount is located within the interior of the noise suppressor are flawed. Exposing the spring of a noise surprise mount to the heat of a discharging firearm anneals the metal causing it to fatigue and ultimately rendering the mount ineffective at retaining the noise suppressor on the host firearm. Materials generally selected for springs are not well suited to the high heat environment present inside of a noise suppressor during use. An example of a noise suppressor utilizing this style of mount is the GemTech G5.

Minimizing the use of secondary latches, rings and other devices simplifies my apparatus making it easy to use. Proper material selection creates a more robust spring while using two springs creates system redundancy which lessons the chance of failure. My design is also backwards compatible with currently produced Advanced Armament noise suppressor flash hider mounts.

OBJECTS AND ADVANTAGES

Accordingly several objects and advantages of the present invention are (a) To provide the capability to quickly attach a noise suppressor to flash hider which has the appropriate threads and secondary retaining device present to receive the proposed noise suppressor mount.

(b) To provide a spring latch with two elbows offset from one another by 10 degrees to ensure that one elbow has positive engagement between the teeth of the gear present on the rear of the flash hider mount.

(c) to provide a secure secondary spring latch which will engage the teeth present on the preferred embodiment flash hider mount thus eliminating unintentional rotation of the noise suppressor due to vibrations resulting from the discharge of a firearm.

(d) To provide an apparatus which may be utilized single handedly.

Still further objects and advantages will become apparent from a consideration of the ensuing description and drawings.

SUMMARY

In general terms the present inventions provides a mount which may be incorporated into a noise suppressor where a fast attached feature would be desirable. The ease of installation which is afforded by my design will be greatly appreciated by the end user of my proposed device.

Specifically my device affords several advantages over other existing designs. There are no moving parts on my mount except the two secondary spring latches which help secure the mount to the host firearm. My mount allows the end user to install a noise suppressor properly equipped onto a firearm with one hand. The secondary spring latches in my design are not exposed to the high temperatures present inside of the noise suppressor thereby minimizing the possibly of annealing said springs. Offsetting the two secondary spring latches 10 degrees ensures that a secure fit will always be achieved when my device is used in conjunction with a flash hider having 18 teeth spread evenly over a 1.5" diameter surface. I will note that the proposed apparatus is not limited to the above flash hider design.

DRAWINGS

The novel features believed to be characteristic of the invention, together with further advantages thereof, will be better understood from the following description considered in connection with the accompanying drawings in which a preferred embodiment of the present invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 2:
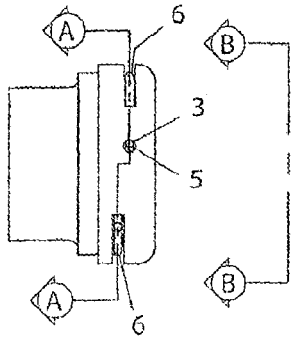
FIG. 2 shows an external, horizontal side view of the noise suppressor redundant mount and spring retaining notch.

Turning now to the drawings in which like reference characters indicate corresponding elements throughout the several views, attention is directed to FIG. 2 which illustrates the preferred embodiment noise suppressor mount 1. Noise suppressor mount 1 includes two main elements, the internal acme threads 10, and the retaining springs 7. Noise suppressor mount 1 is permanently coupled to noise suppressor 8 by a circumferential weld.

Figure 1:
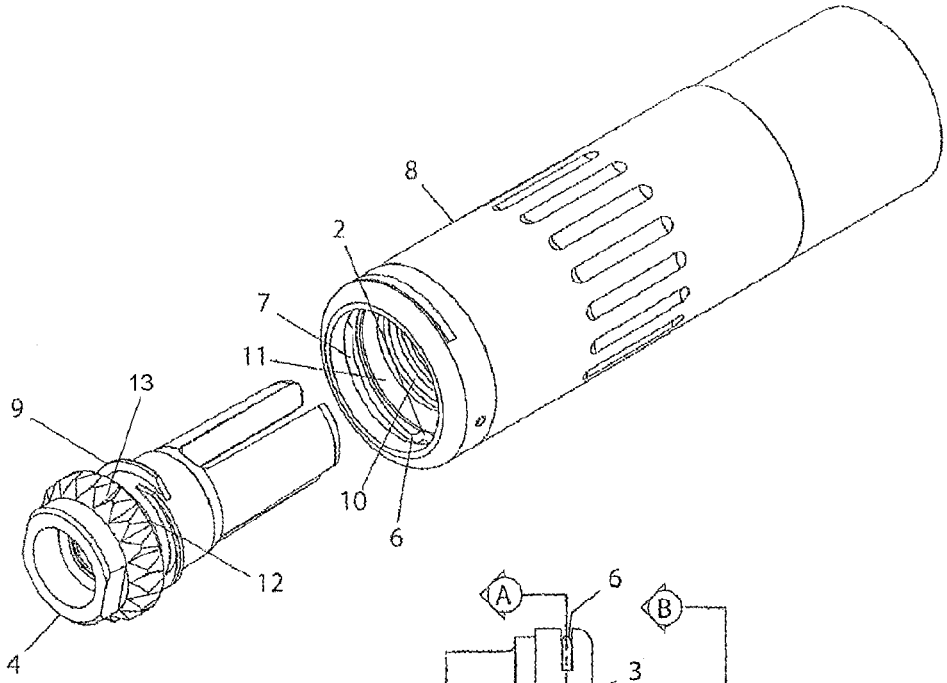
FIG. 1 shows an external side view of a flash hider and a noise suppressor with the proposed noise suppressor redundant mount installed.

In FIG. 1, there is illustrated a view of how the flash hider 4 should be oriented prior to insertion within the noise suppressor mount 1. Once the flash hider 4 is fully seated into the noise suppressor mount 1 the acme threads 9 present about the flash hider 4 will threadedly secure to the noise suppressor mount acme threads 10.

Figure 3:
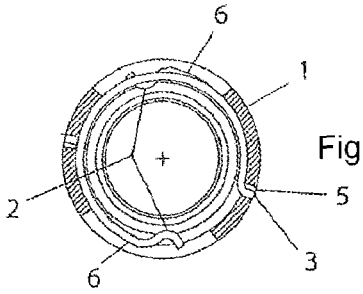
FIG. 3 shows a top view of the proposed noise suppressor redundant mount.

In FIGS. 2 & 3, there is illustrated in FIG. 1 an example of a noise suppressor mount 1 to which an Advanced Armament flash hider 4 would be inserted and threadedly secured. Advanced Armaments single lead ACME thread mounts incorporated onto a flash hider 4 are well known in the prior art. Spring latches 7 are restrained in noise suppressor mount 1 by means of spring retaining notch 5 restraining spring retainer 3. Outward movement of spring latch 7 is facilitated by (2) mount relief's 6 provided on the noise suppressor mount 1. The retaining springs 7 are placed one before the other as show by the (A) view.

Figure 4:
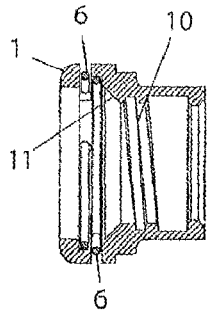
FIG. 4 shows an internal, side view of the proposed noise suppressor redundant mount.

In FIG. 4, shows an internal view of the noise suppressor mount 1 illustrating the location of the noise suppressor mount acme threads 10, and mount reliefs 6. The seating surface 12 located on the flash hider 4 presses against the seating surface 11 of the noise suppressor mount 1 ensuring that flash hider 4 is properly centered with the noise suppressor mount 1.

Figure 5:
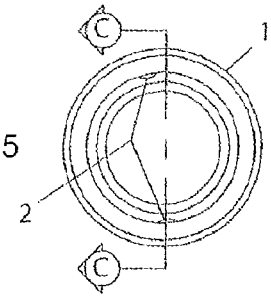
FIG. 5 shows a bottom view of the proposed noise suppressor redundant mount.
Figure 6:
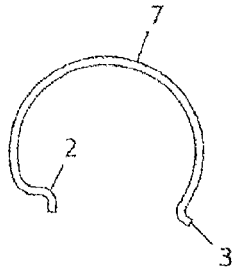
FIG. 6 shows an example of the two springs used in the preferred embodiment of the noise suppressor redundant mount.

In FIG. 5, shows a bottom view of the noise suppressor mount showing how the two retaining springs 7 are oriented within the noise suppressor mount 1.

As used herein, the word "front" or "forward" corresponds to the firing direction of the firearm (i.e., to the right as shown in FIG. 2); "rear" or "rearward" or "back" corresponds to the direction opposite the firing direction of the firearm (i.e., to the left as shown in FIG. 2); "longitudinal" means the direction along or parallel to the longitudinal axis a of the noise suppressor mount 1; and "transverse" means a direction perpendicular to the longitudinal direction.

Noise suppressor mount 1 is secured to the noise suppressor 8 by circumferentially welding the mount to the body of the noise suppressor 8. The spring retaining notch 5 is drilled into the back of the noise suppressor mount 1. Two mount reliefs are machined into the side of the noise suppressor mount 1, housing the retaining springs 7 and allowing the spring elbows 2 clearances to move outwards while the noise suppressor mount 1 is being threadedly secured about the flash hider 4. The noise suppressor mount 1 is threadedly secured to flash hider 4 by means of the flash hider male threads 9 and the noise suppressor mount threads 10. The noise suppressor mount 1 is secured once the seating surfaces 11, 12 are in contact. The threads are the primary means of attachment for my proposed apparatus while the retaining springs 7 serve as a secondary means.

The retaining springs 7 are offset by 10 degrees to minimize rotational movement of the noise suppressor mount 1 while mounted on the flash hider 7. The offset retaining springs 7 minimize the potential for a gap between the two seating surfaces when the noise suppressor mount 1 is threadedly secured about the flash hider 7. With one retaining spring 7 always landing in the valley of a retaining notch 13 located about flash hider 4 movement in the noise suppressor mount 1 is minimized and thereby minimizing the possibility of a bullet contacting the baffles of the noise suppressor 8 or poor accuracy of the host firearm.

The noise suppressor mount 1 is machined from 316 stainless while the retaining springs 7 are formed from stainless wire.

CONCLUSION, RAMIFICATION, AND SCOPE

Accordingly the reader will see that, according to the invention, I have provided a system for threadedly securing a noise suppressor equipped with my apparatus about a flash hider. I have afforded the user of my product the ability to securely retain the noise suppressor with minimal rotational or side to side movement once the noise suppressor is fully seated. The two secondary spring latches of my apparatus ensure that once the mount is fully threaded on the acme threads of the flash hiders, one of the secondary spring latches will fully engage the retaining notches located about the circumference of said flash hider.

While my above drawings and description contain many specificities, these should not be construed as limitations on the scope of the invention, but rather as an exemplification of one preferred embodiment thereof. For example, my design is not limited to the use of two secondary spring latches, three of more secondary spring latches may be uses and offset set at various degrees if more strength is required from the secondary retaining deices.

Accordingly, the scope of the invention should be determined not by the embodiments illustrated, but by the appended claims and their legal equivalents."

The invention claimed is:

1. A firearm noise suppressor mount, comprising: an adapter including a flash hider configured for coaxial attachment to a firearm muzzle, a suppressor attachment thread, and a plurality of uniformly spaced external engagement teeth with notches there-between circumscribing the adapter and axially spaced from the suppressor attachment thread . . . do not simultaneously engage notches.

2. The noise suppressor mount of claim 1, wherein said interface structure thread includes an internal acme thread.

3. The noise suppressor mount of claim 1, wherein said interface structure includes a housing welded to the noise suppressor body.

4. The noise suppressor mount of claim 2, wherein said internal acme thread is a single lead stub acme thread.

5. The noise suppressor mount of claim 1, wherein said latches are circumferentially offset ten degrees.

6. The noise suppressor mount of claim 1, wherein said plurality of latches comprise at least one spring member having a plurality of integral elbows configured to engage with the teeth and notches of the adapter.

7. The noise suppressor mount of claim 1, wherein said plurality of latches comprise a plurality of spring members circumferentially and axially offset from one another, each having an integral elbow configured to engage with the teeth and notches of the adapter.

* * * * *

UNITED STATES PATENT AND TRADEMARK OFFICE

CERTIFICATE OF CORRECTION

PATENT NO. : 7,743,693 B1
APPLICATION NO. : 11/894205
DATED : June 29, 2010
INVENTOR(S) : Kevin Tyson Brittingham It is certified that error appears in the above-identified patent and that said Letters Patent is hereby corrected as shown below:

Claim 1, col. 4, lines 41-42: delete "... do not simultaneously engage notches."

and substitute:

"; and interface structure for coaxially securing a noise suppressor body to the adapter comprising a thread configured to engage the attachment thread of the adapter and a plurality of spring biased latches positioned to engage with the adapter teeth and notches, wherein the latches alternately pass over teeth and notches as the noise suppressor is threadingly mounted on the adapter and are circumferentially positioned such that all latches do not simultaneously engage notches."

Signed and Sealed this

Ninth Day of November, 2010

David J. Kappos

David J. Kappos
*Director of the United States Patent and Trademark Office*